US008287608B2

(12) United States Patent
Schwab

(10) Patent No.: US 8,287,608 B2
(45) Date of Patent: Oct. 16, 2012

(54) LUBRICITY ADDITIVE FOR FUELS

(75) Inventor: Scott D. Schwab, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 1085 days.

(21) Appl. No.: 11/166,152

(22) Filed: Jun. 27, 2005

(65) Prior Publication Data

US 2006/0288638 A1 Dec. 28, 2006

(51) Int. Cl.
*C10L 1/22* (2006.01)

(52) U.S. Cl. ..... 44/412; 44/385

(58) Field of Classification Search ..... 44/385, 44/412

See application file for complete search history.

(56) References Cited

U.S. PATENT DOCUMENTS

| | | | | |
|---|---|---|---|---|
| 3,522,022 | A | 7/1970 | May et al. | |
| 4,040,799 | A * | 8/1977 | Oude Alink et al. | 44/412 |
| 4,737,159 | A | 4/1988 | Phillips | |
| 5,538,653 | A | 7/1996 | Avery et al. | |
| 5,717,039 | A * | 2/1998 | Cusumano et al. | 525/340 |
| 5,833,722 | A | 11/1998 | Davies et al. | |
| 6,129,772 | A * | 10/2000 | Weers et al. | 44/385 |
| 6,328,771 | B1 | 12/2001 | Moreton | |
| 6,610,111 | B2 | 8/2003 | Krull et al. | |
| 6,793,695 | B2 * | 9/2004 | Wilkes et al. | 44/385 |
| 6,793,696 | B2 | 9/2004 | Krull et al. | |
| 2003/0172584 | A1 | 9/2003 | Henly et al. | |
| 2004/0083644 | A1 * | 5/2004 | Krull et al. | 44/385 |

FOREIGN PATENT DOCUMENTS

| | | |
|---|---|---|
| EP | 0798364 A1 | 10/1997 |
| EP | 1 209 217 | 5/2002 |
| GB | 793737 | 4/1958 |
| GB | 824405 | 12/1959 |
| GB | 848910 | 9/1960 |
| GB | 848911 | 9/1960 |
| GB | 1169860 | 11/1969 |
| WO | WO 99/36489 | 7/1999 |

* cited by examiner

*Primary Examiner* — Michael Marcheschi
*Assistant Examiner* — Chantel Graham
(74) *Attorney, Agent, or Firm* — Fitch, Even, Tabin & Flannery, LLP; Dennis H. Rainear

(57) ABSTRACT

The present teachings are directed toward a lubricity additive for fuel compositions that is a mixture of an amine having at least one alicyclic group and a monocarboxylic acid having up to 22 carbon atoms.

13 Claims, 2 Drawing Sheets

LUBRICITY ADDITIVE FOR FUELS

BACKGROUND

1. Field of the Invention

The present teachings relate to lubricity additives for fuels and methods to use the additives in fuels.

2. Discussion of the Related Art

Monocarboxylic acids, or fatty acids, have long been recognized as effective lubricity additives for diesel fuels. Unfortunately, many commercially available fatty acids and fatty acid blends tend to freeze or form crystals at temperatures common during winter weather. The freezing or formation of crystals makes handling of the additives, and particularly injection into fuel difficult. Blending the fatty acid with a solvent can reduce the crystal formation temperature, or cloud point. However, addition of a solvent will increase cost and complexity.

The fatty acids, fatty acid ammonium salts and fatty acid amides presently used have the disadvantage of solidifying on storage at low temperatures, frequently even at room temperature, usually at temperatures of 0° C., or crystalline fractions separate and cause handling problems. Diluting the additives with organic solvents only partly solves the problem, since fractions will still crystallize out from solutions or the solution will gel and solidify. Thus, for use as lubricity additives, the fatty acids, fatty acid ammonium salts and fatty acid amides either have to be greatly diluted or kept in heated storage vessels and added via heated pipework.

The present teachings provide lubricity additives that enhance the lubricity of fuels, especially middle distillate fuels, and remain homogeneous, clear and flowable at low temperatures. Additionally, the cold flow properties of middle distillate fuels are not adversely affected.

A need exists, therefore, for enhancement of lubricity additive formularies, to result in a lowering of the cloud point, without deleterious effects on other desired properties.

SUMMARY

The present teachings satisfy the need for enhanced fuel lubricity additives, particularly for fuel compositions with ultra-low, less than about 15 ppm, sulfur.

The present teachings include a composition including a mixture of at least one amine having at least one alicyclic group and at least one monocarboxylic acid, or fatty acid, having between eight and 22 carbon atoms.

The present teachings also include a fuel composition having a major amount of a low sulfur-content fuel, and a minor amount of an additive consisting of a mixture of at least one amine having at least one alicyclic group and at least one monocarboxylic acid, or fatty acid, having between eight and 22 carbon atoms. The low sulfur-content fuel can have a maximum sulfur content of about 500 ppm.

The methods of the present teachings include a method of increasing the lubricity of a fuel composition by incorporating into the fuel composition, a mixture of at least one amine having at least one alicyclic group and at least one monocarboxylic acid, or fatty acid, having between eight and 22 carbon atoms.

BRIEF DESCRIPTION OF THE FIGURES

The accompanying figures, which are included to provide a further understanding of the present teachings and are incorporated in and constitute a part of this specification, illustrate various embodiments of the present teachings and together with the detailed description serve to explain the principles of the present teachings. In the figures.

DETAILED DESCRIPTION

Figure 1:
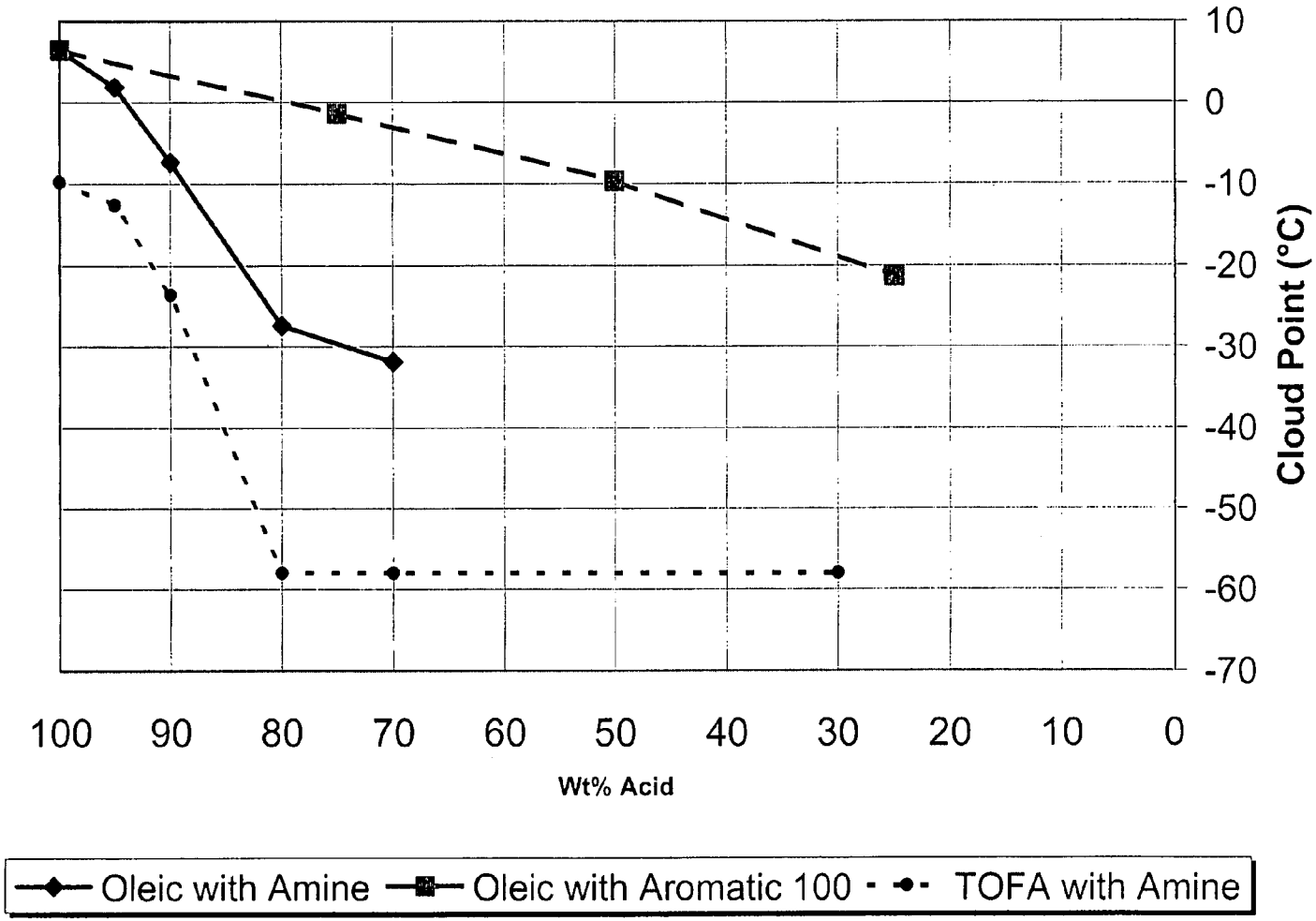
FIG. 1 is a graph illustrating the results of cloud point testing on three different formulations.

The present teachings relate to lubricity additives for fuels and methods to use the additives in fuels.

Ultra-low sulfur-content fuels, containing less than 15 ppm sulfur, have inherent lubricating properties that are less than higher sulfur-content fuels, thus necessitating the need for inclusion of certain lubricity additives. The use of these lubricity additives makes it possible to avoid mechanical failure problems, such as fuel pump failure, otherwise caused by the inadequate inherent fuel lubricity, while still retaining the significant environmental benefits of using a low sulfur fuel. As set forth above, present additive formulations can have cloud point temperatures that are too high for winter use.

In the present context, the term "ultra-low sulfur-content fuel" is intended to mean fuels typically having a maximum sulfur content of about 500 ppm, and more preferably less than 15 ppm by weight. Examples of such fuels include low sulfur middle distillate fuels, such as diesel and jet fuels, and bio-diesel fuels. Middle distillate fuels are usually characterized as having a boiling range of about 100 to about 500° C., more typically from about 150 to about 400° C. Bio-diesel fuel can be derived from a vegetable source or mixture thereof with a petroleum-based fuel and typically contains vegetable oils or their derivatives. Gasoline can also be included in the fuels which have ultra-low sulfur content.

As used in the present context, the term "fatty acid" refers to monocarboxylic acids with 8 to 40 carbon atoms, typically 8 to 22 carbon atoms. The fatty acids, although usually saturated, can contain one or more double carbon-carbon bonds, and can be of natural or synthetic origin.

As used in the present context, the term "alicylic" refers to groups of organic compounds having carbon atoms arranged in closed ring structures, that are not aromatic ring structures. Examples of alicyclic structures include, but are not limited to, cycloparaffins, such as, cyclopropane, cyclopentane, and cyclohexane, cycloolefins, such as, cyclopentadiene and cyclooctatetraene, and cycloacetylenes having at least one triple carbon-carbon bond.

According to the present teachings, a composition comprising a mixture of at least one amine having at least one alicyclic group and at least one monocarboxylic acid having between eight and 22 carbon atoms is taught. The amine can comprise a dialkyl alicyclic amine, wherein the alkyl groups of the dialkyl have between one and eight carbon atoms, and can be the same or different alkyls. According to the present teachings, the mixture of the amine and the monocarboxylic acid can be substantially free of the amide reaction product of the amine and the acid.

According to the present teachings, the alkyl radicals of the monocarboxylic acids consist essentially of carbon and hydrogen. However, they may carry further substituents such as for example hydroxyl, hydrogen, amino or nitro groups, provided these do not impair the predominant hydrocarbon character. Useful monocarboxylic acids, or fatty acids, include for example lauric acid, tridecanoic acid, myristic acid, pentadecanoic acid, palmitic acid, margaric acid, stearic acid, isostearic acid, arachidic acid, behenic acid, oleic acid, erucic acid, palmitoleic acid, myristoleic acid, linoleic acid, linolenic acid, elaeosteric acid and arachidonic acid, ricinoleic acid and also fatty acid mixtures obtained from natural fats and oils, for example coconut oil fatty acid, peanut oil fatty acid, fish oil fatty acid, linseed oil fatty acid, palm oil fatty acid, rapeseed oil fatty acid, castor oil fatty acid, colza oil fatty acid, soybean oil fatty acid, sunflower oil fatty acid, and tall oil fatty acid. According to the present teachings, in a preferred embodiment, the monocarboxylic acid can be oleic acid.

According to the present teachings, the amine can include, for example, at least one member selected from the group consisting of N,N-dimethylcyclohexylamine, N,N-diethylcyclohexylamine, N,N-dipropylcyclohexylamine, N,N-dibutylcyclohexylamine, N,N-dimethylcyclopentylamine, N,N-diethylcyclopentylamine, N,N-dipropylcyclopentylamine, N,N-dibutylcyclopentylamine, N,N-dicyclohexylamine, N-methyl-N-ethylcyclohexylamine, N-methyl-N-propylcyclohexylamine, N-methyl-N-butylcyclohexylamine, and mixtures thereof. In a preferred embodiment of the present teachings, the amine can be N,N-dimethylcyclohexylamine.

According to the present teachings, a composition of particular interest contains N,N-dimethylcyclohexylamine and oleic acid. In addition, the compositions according to the present teachings contain a mixture of the amine and the monocarboxylic acid, as described above, and the mixture is substantially free of solvents. Examples of solvents include, without limitation, white spirit, kerosene, alcohols, for example, 2-ethyl hexanol, isopropanol and isodecanol, high boiling point aromatic solvents, for example, toluene, xylene, and cetane improvers, for example, 2-ethyl hexylnitrate.

In another embodiment of the present teachings, a composition consisting of a mixture of N,N-dimethylcyclohexylamine and oleic acid is taught.

In another aspect, the present teachings relate to fuel compositions containing a minor amount of an additive, which imparts excellent lubricating properties to the fuel, where the additive includes a mixture of at least one amine having at least one alicyclic group and at least one monocarboxylic acid having between eight and 22 carbon atoms. According to the present teachings, the mixture of the amine and the monocarboxylic acid can be substantially free of the amide reaction product of the amine and the acid. According to the present teachings, the additives enhance the lubricating properties of the fuel without degrading other performance features of the fuel, such as detergency, ignition quality, stability, and so on. The major amount of the fuel composition contains a low sulfur-content fuel having a maximum sulfur content of about 500 ppm.

According to the present teachings, the fuel composition can include a dialkyl alicyclic amine, wherein the alkyl groups of the dialkyl can have between one and eight carbon atoms, and can be the same or different alkyls. Specifically, the amine can be at least one member selected from the group consisting of N,N-dimethylcyclohexylamine, N,N-diethylcyclohexylamine, N,N-dipropylcyclohexylamine, N,N-dibutylcyclohexylamine, N,N-dimethylcyclopentylamine, N,N-diethylcyclopentylamine, N,N-dipropylcyclopentylamine, N,N-dibutylcyclopentylamine, N,N-dicyclohexylamine, N-methyl-N-ethylcyclohexylamine, N-methyl-N-propylcyclohexylamine, N-methyl-N-butylcyclohexylamine, and mixtures thereof.

According to the present teachings, the fuel composition can include a monocarboxylic acid which can be at least one member selected from the group consisting of lauric acid, tridecanoic acid, myristic acid, pentadecanoic acid, palmitic acid, margaric acid, stearic acid, isostearic acid, arachidic acid, behenic acid, oleic acid, erucic acid, palmitoleic acid, myristoleic acid, linoleic acid, linolenic acid, elaeosteric acid, arachidonic acid, ricinoleic acid, coconut oil fatty acid, peanut oil fatty acid, fish oil fatty acid, linseed oil fatty acid, palm oil fatty acid, rapeseed oil fatty acid, castor oil fatty acid, colza oil fatty acid, soybean oil fatty acid, sunflower oil fatty acid, tall oil fatty acid, and mixtures thereof.

According to the present teachings, a preferred embodiment can include an amine that consists of N,N-dimethylcyclohexylamine. Another preferred fuel composition can include oleic acid as the monocarboxylic acid. According to the present teachings, another preferred fuel composition can have both N,N-dimethylcyclohexylamine and oleic acid in the fuel composition.

According to the present teachings, the fuel in the fuel composition has a maximum sulfur content of about 15 ppm by weight. According to the present teachings, the fuel in the fuel composition can be at least one member selected from the group consisting of diesel fuel, jet fuel, bio-diesel fuel, and gasoline.

According to the present teachings, the mixture is present in the fuel composition in an amount ranging from about 10 ppm to about 500 ppm, or in an amount ranging from about 50 ppm to about 200 ppm. According to the present teachings, the mixture of the amine and the monocarboxylic acid is substantially free of solvents.

According to the present teachings, the fuel can have a maximum sulfur content of 500 ppm, and in one embodiment of the fuel composition, the amine is N,N-dimethylcyclohexylamine, the monocarboxylic acid is oleic acid, and the additive is substantially free of the amide reaction product of the amine and the monocarboxylic acid.

In another aspect, the present teachings relate to a method of enhancing lubricity of a fuel composition by incorporating into a fuel a lubricity additive that includes a mixture of at least one amine having at least one alicyclic group and at least one monocarboxylic acid having between eight and 22 carbon atoms. The method provides the benefit of reducing the wear on a engine components, particularly fuel pumps used for pumping diesel fuel. According to the present teachings, the mixture of the amine and the monocarboxylic acid is substantially free of the amide reaction product of the amine and the acid.

According to the present teachings, the method of increasing the lubricity of a fuel composition incorporates a mixture of at least one amine having at least one alicyclic group and at least one monocarboxylic acid having between eight and 22 carbon atoms into the fuel composition. In one embodiment, the amine includes a dialkyl alicyclic amine, wherein the alkyl groups of the dialkyl have between one and eight carbon atoms, and can be the same or different alkyls.

According to the present teachings, the amine includes at least one member selected from the group consisting of N,N-dimethylcyclohexylamine, N,N-diethylcyclohexylamine, N,N-dipropylcyclohexylamine, N,N-dibutylcyclohexylamine, N,N-dimethylcyclopentylamine, N,N-diethylcyclopentylamine, N,N-dipropylcyclopentylamine, N,N-dibutylcyclopentylamine, N,N-dicyclohexylamine, N-methyl-N-ethylcyclohexylamine, N-methyl-N-propylcyclohexylamine, N-methyl-N-butylcyclohexylamine, and mixtures thereof.

According to the present teachings, the monocarboxylic acid includes at least one member selected from the group consisting of lauric acid, tridecanoic acid, myristic acid, pentadecanoic acid, palmitic acid, margaric acid, stearic acid, isostearic acid, arachidic acid, behenic acid, oleic acid, erucic acid, palmitoleic acid, myristoleic acid, linoleic acid, linolenic acid, elaeosteric acid, arachidonic acid, ricinoleic acid, coconut oil fatty acid, peanut oil fatty acid, fish oil fatty acid, linseed oil fatty acid, palm oil fatty acid, rapeseed oil fatty acid, castor oil fatty acid, colza oil fatty acid, soybean oil fatty acid, sunflower oil fatty acid, tall oil fatty acid, and mixtures thereof.

According to an embodiment of the present teachings, the method of increasing lubricity utilizes N,N-dimethylcyclohexylamine. In another embodiment, the method utilizes oleic acid. In yet another embodiment of the present teachings, the method incorporates both N,N-dimethylcyclohexylamine and oleic acid.

According to the present teachings, the method of increasing lubricity utilizes the mixture of the amine and monocarboxylic acid in a fuel composition in an amount ranging from about 10 ppm to about 500 ppm, or in an amount ranging from about 50 ppm to about 200 ppm. According to the present teachings, the fuel composition has a maximum sulfur content of about 15 ppm by weight, and is at least one member selected from the group consisting of diesel fuel, jet fuel, bio-diesel fuel, and gasoline.

According to the present teachings, the amine and monocarboxylic acid mixture utilized in the method is substantially free of solvents prior to incorporation into the fuel composition.

All publications, articles, papers, patents, patent publications, and other references cited herein are hereby incorporated herein in their entireties for all purposes.

Although the foregoing description is directed to the preferred embodiments of the present teachings, it is noted that other variations and modifications will be apparent to those skilled in the art, and which may be made without departing from the spirit or scope of the present teachings.

The following examples are presented to provide a more complete understanding of the present teachings. The specific techniques, conditions, materials, and reported data set forth to illustrate the principles of the present teachings are exemplary and should not be construed as limiting the scope of the present teachings.

Sample Evaluations

Cloud Point Testing

The improvement in depressing cloud point temperature is illustrated in FIG. 1. The sample formulations were tested for cloud point temperature by use of the ASTM D 5772-03 test method. The test results, in degree Celsius, are tabulated in Table 1, and demonstrate the achievement of surprising enhancements in cloud point.

TABLE 1

Cloud Point Temperature Testing

| Weight % Acid | Oleic Acid w/Solvent | Oleic Acid w/Amine | TOFA w/Amine |
|---|---|---|---|
| 100 | 6.5 | 6.5 | −9.5 |
| 95 | | 1.9 | −12.6 |
| 90 | | −7.4 | −23.6 |
| 80 | | −27.4 | <−58 |
| 75 | −1.4 | | |
| 70 | | −31.9 | <−58 |
| 50 | −9.7 | | |
| 30 | | | <−58 |
| 25 | −21.3 | | |

For the cloud point testing, "solvent" refers to Aromatic 100 Solvent as sold by ExxonMobil Chemical (Houston, Tex.), "amine" refers to N,N-dimethylcyclohexylamine, "TOFA" refers to tall oil fatty acid as sold by Arizona Chemical (Jacksonville, Fla.), and "oleic acid" refers to OL-700 sold by Procter and Gamble Chemicals (Cincinnati, Ohio).

Figure 2:
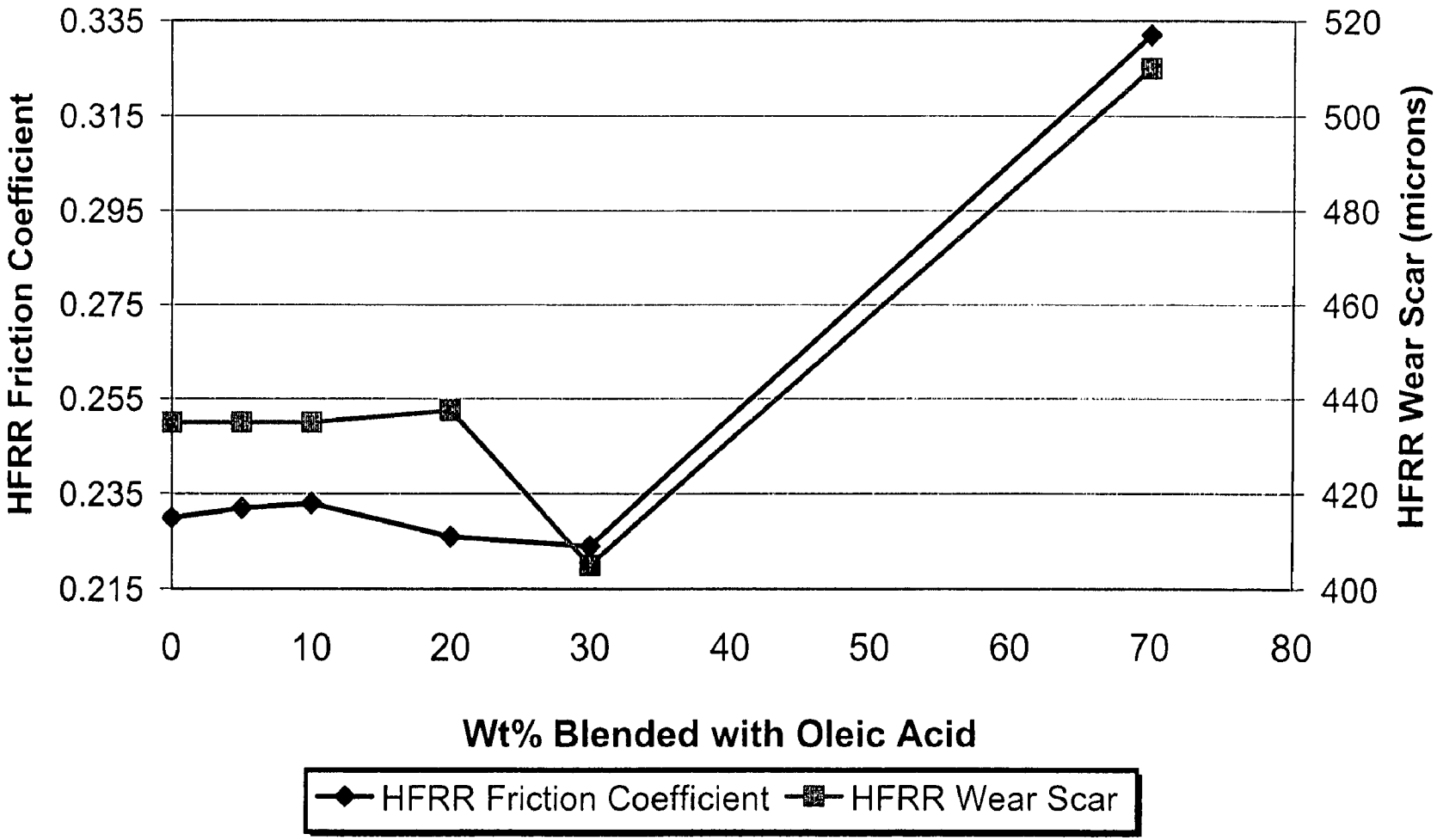
FIG. 2 is a graph illustrating the results of HFRR (High Frequency Reciprocating Rig) testing on two different formulations.

Performance tests were conducted using a HFRR (High Frequency Reciprocating Rig, ASTM D6079). The results demonstrate the achievement of surprising enhancements in lubricity, and are presented in FIG. 2 and Table 2.

TABLE 2

HFRR Testing

| Weight % Acid | Friction Coefficient | Avg. Wear Scar Diameter (microns) |
|---|---|---|
| 100 | 0.230 | 435 |
| 95 | 0.232 | 435 |
| 90 | 0.233 | 435 |
| 80 | 0.226 | 437.5 |
| 70 | 0.224 | 405 |
| 30 | 0.332 | 510 |

The foregoing detailed description of the various embodiments of the present teachings has been provided for the purposes of illustration and description. It is not intended to be exhaustive or to limit the present teachings to the precise embodiments disclosed. Many modifications and variations will be apparent to practitioners skilled in this art. The embodiments were chosen and described in order to best explain the principles of the present teachings and their practical application, thereby enabling others skilled in the art to understand the present teachings for various embodiments and with various modifications as are suited to the particular use contemplated. It is intended that the scope of the present teachings be defined by the following claims and their equivalents.

I claim:

1. A method of depressing cloud point temperature of a lubricity additive for low sulfur fuels, the method comprising:

combining about 5 to about 30 weight percent of N,N-dimethylcyclohexylamine with an unsaturated lubricity additive selected from the group consisting of oleic acid, tall oil fatty acid and mixtures thereof to form a liquid lubricity additive mixture that is substantially free of an amide reaction product between the N,N-dimethylcyclohexylamine and the lubricity additive; and depressing the cloud point of the lubricity additive mixture to about 1.9° C. or less.

2. The method of claim 1, wherein the cloud point temperature of the lubricity additive mixture is depressed to less than −58° C.

3. The method of claim 1, wherein the lubricity additive is oleic acid.

4. A lubricity additive composition for low sulfur fuels, said composition having a depressed cloud point temperature, the lubricity additive composition comprising:

a liquid mixture of about 5 to about 30 weight percent of N,N-dimethylcyclohexylamine and one or more unsaturated monocarboxylic acid(s) selected from the group consisting of oleic acid, and tall oil fatty acid, the liquid mixture substantially free of an amide reaction product between the N,N-dimethylcyclohexylamine and the one or more unsaturated monocarboxylic acid(s); and said mixture exhibits a depressed cloud point temperature of about 1.9° C. or below relative to a cloud point temperature of the one or more monocarboxylic acid(s).

5. The lubricity additive composition of claim 4, wherein the monocarboxylic acid is oleic acid.

6. The lubricity additive composition of claim 4, wherein the lubricity additive mixture is N,N-dimethylcyclohexylamine, oleic acid and tall oil fatty acid.

7. The lubricity additive composition of claim 4, wherein the cloud point temperature of the lubricity additive mixture is depressed to less than −58° C.

8. The method of claim 1, wherein the lubricity additive is tall oil fatty acid.

9. The method of claim 3, wherein the lubricity additive mixture in the fuel exhibits an average wear scar diameter of about 437 microns or lower in accordance with ASTM D6079.

10. The lubricity additive composition of claim 4, wherein the monocarboxylic acid is tall oil fatty acid.

11. The lubricity additive composition of claim 4, wherein said mixture in the fuel exhibits an average wear scar diameter of about 437 microns or lower in accordance with ASTM D6079.

12. The lubricity additive composition of claim 11, wherein the monocarboxylic acid is oleic acid.

13. A fuel composition comprising a minor amount of the lubricity additive composition of claim 1 and a major amount of a low sulfur-content fuel comprising a maximum sulfur content of about 15 ppm.

* * * * *

UNITED STATES PATENT AND TRADEMARK OFFICE

CERTIFICATE OF CORRECTION

PATENT NO. : 8,287,608 B2
APPLICATION NO. : 11/166152
DATED : October 16, 2012
INVENTOR(S) : Scott D. Schwab It is certified that error appears in the above-identified patent and that said Letters Patent is hereby corrected as shown below:

Column 8, line 10, delete "claim 1" and insert --claim 4-- therefor.

Signed and Sealed this
Twelfth Day of February, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,287,608 B2
APPLICATION NO. : 11/166152
DATED : October 16, 2012
INVENTOR(S) : Schwab It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1133 days.

Signed and Sealed this
Twenty-third Day of September, 2014

Michelle K. Lee

Michelle K. Lee
*Deputy Director of the United States Patent and Trademark Office*